United States Patent [19]

Machesney

[11] Patent Number: 4,485,285

[45] Date of Patent: Nov. 27, 1984

[54] QUARTERWAVE CHOKE FOR A MICROWAVE OVEN QUARTZ LAMP

[75] Inventor: Gregory W. Machesney, Oakdale, Minn.

[73] Assignee: Control Data Corporation, Minneapolis, Minn.

[21] Appl. No.: 472,899

[22] Filed: Mar. 7, 1983

[51] Int. Cl.[3] ..... H05B 6/76

[52] U.S. Cl. ..... 219/10.55 D; 219/10.55 B

[58] Field of Search ..... 219/10.55 D, 10.55 B, 219/10.55 R, 10.55 F, 10.55 E

[56] References Cited

U.S. PATENT DOCUMENTS 4,137,442 1/1979 Tateda ..... 219/10.55 B
4,191,877 3/1980 Tanaka et al. ..... 219/10.55 D X
4,357,513 11/1982 Kawata et al. ..... 219/10.55 B
4,358,653 11/1982 Weiss ..... 219/10.55 D X

FOREIGN PATENT DOCUMENTS 57-28926 2/1982 Japan ..... 219/10.55 D

*Primary Examiner*—P. H. Leung
*Attorney, Agent, or Firm*—Edward P. Heller; Joseph A. Genovese

[57] ABSTRACT

Quarterwave chokes mounted on the ends of a quartz lamp about the power leads to the lamp and further mounted on the interior cavity wall of a microwave oven. The chokes permit connection of the quartz lamp to a power source via power leads passing through the cavity wall without allowing microwave energy to escape from the cavity along the power leads.

10 Claims, 1 Drawing Figure

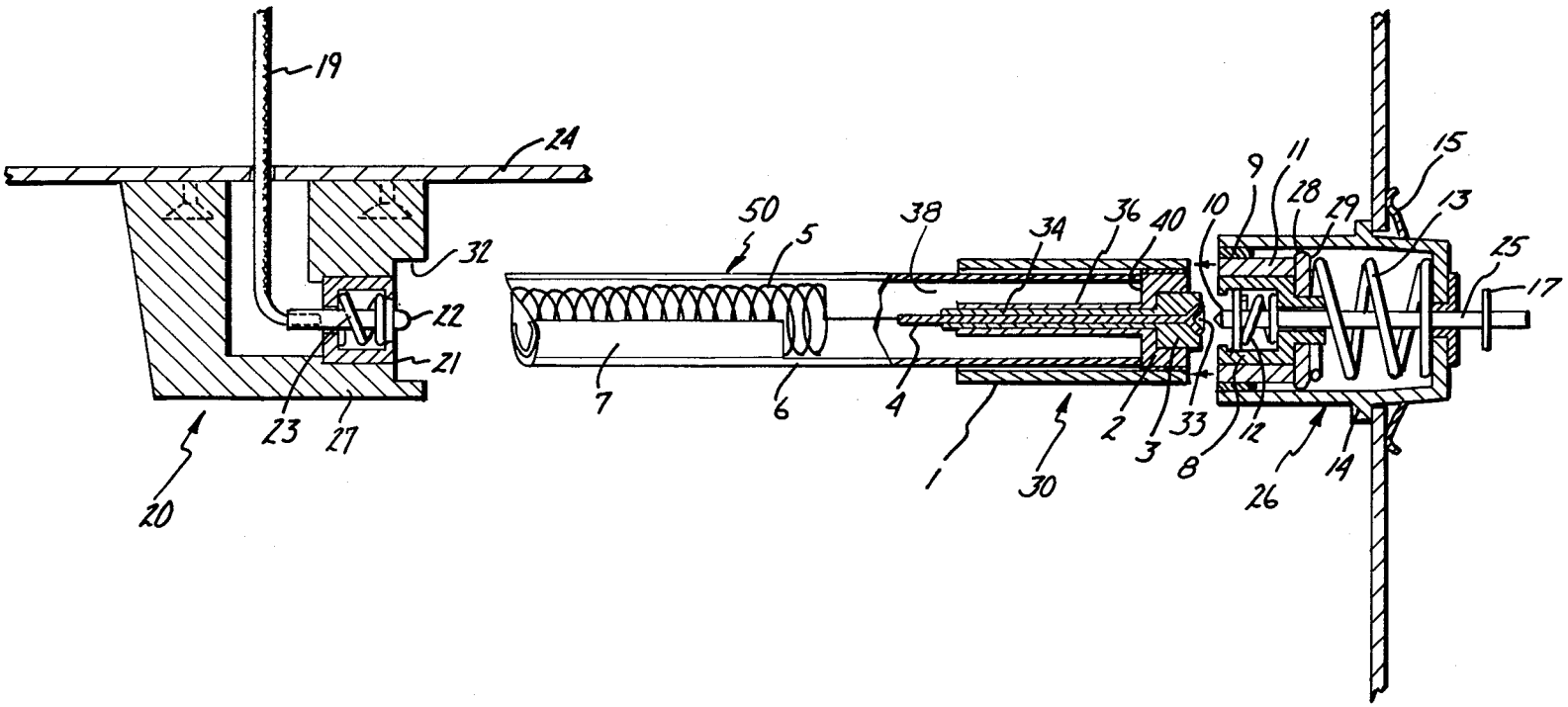
17
25
15
13
29
28
11
9
10
14
26
12
8
33
3
2
40
36
34
30
1
38
4
5
6
50
7
24
32
22
21
27
19
23
20

QUARTERWAVE CHOKE FOR A MICROWAVE OVEN QUARTZ LAMP

BACKGROUND OF THE INVENTION

1. Field of Invention

The invention relates generally to microwave ovens and more particularly to resistance heating elements mounted therein and quarterwave chokes.

2. Brief Description of the Prior Art

Resistance heating elements in microwave ovens have commonly been of two types: a shielded rode heater or otherwise known as a "Calrod"; and quartz lamp heaters. In the former type, microwaves are shielded from the electrically conductive resistance element by action of the shielding element, which is commonly grounded to the microwave oven cavity wall. In the latter type of heating element, the resistance element has no shield. Therefore, unless shielded by other means, microwaves would impinge upon the conductor and be transmitted through the cavity wall. This is unacceptable. Thus quartz lamps, when included in microwave ovens, have commonly included metal shielding elements entirely enclosing the quartz lamp.

However, this structure has the drawback that the shielding structure substantially masks the transmission of infrared radiation. The performance of the quartz lamp heater is degraded. To overcome this limitation, a structure shown in Mittelsteadt et al, Ser. No. 434,301, employs a quarterwave choke structure mounted exterior to the microwave oven cavity about the exit point of the heater's power lead from a shielded housing. A similar structure is shown in Weiss U.S. Pat. No. 4,358,653 with respect to "Calrods.".

However, it has been found that the Mittlesteadt structure causes the power lead to heat up to an unacceptable degree at its point of exit from the microwave oven cavity. Similarly, the shielded housing structure itself heats to an unacceptable degree.

SUMMARY OF THE INVENTION

The present invention represents the discovery that employing a quarterwave choke interior of the microwave oven cavity at the point of exit of the quartz lamp conductor from the cavity not only chokes off microwaves but also eliminates the overheating problem.

In this regard, the present quarterwave choke structure comprises an outer cylinder surrounding an inner cylinder which in turn surrounds the conductor. The conductor is separated from the inner cylinder by a narrow sheath of insulator. The outer conductor is separated from the inner cylinder by an air gap. The length of the gap from an open end to a conducting plug is an effective quarterwavelength. The gap dimension between the conductor and inner cylinder is critical.

BRIEF DESCRIPTION OF THE DRAWING

The drawing shows a cross-section of a quartz lamp heater having a quarterwave choke mounted on the interior of a microwave oven cavity according to the present invention.

DESCRIPTION OF THE PREFERRED EMBODIMENT

The FIGURE shows a partial cross-sectional view of a quartz lamp heater 50 in combination with the quarterwave choke 30 of the present invention mounted in a microwave oven cavity. Only partial views of the top wall 24 and back sidewall 18 of the cavity are shown. The quartz lamp is aligned front to back: the front is to the left and the rear to the right in the FIGURE. The particular orientation of the quartz lamp in the microwave oven is not a feature of the present invention.

The quartz lamp 50 is comprised of a quartz tube 6, ceramic blinder 7, and resistance heat element 5. These are old devices and they do not form a part of the present invention.

The quartz lamp 50 mounts in the front of the cavity in front socket assembly 20 which includes a flexible, insulated power lead 19, ceramic insulator 21, contact pin 22 attached to power lead 19, and spring 23. These devices again do not form a part of the present invention.

The quartz lamp 50 mounts at the rear of the cavity in a rear socket assembly 26 comprised of a flexible insulated power lead 25, ceramic cylindrical insulator 8, metallic keeper/r.f. seal 9, contact pin 10 connected to power lead 25, metallic cylindrical housing 11, contact spring 12, cylindrical housing spring 13, metallic socket housing 14, socket housing retaining ring 15, insulator 16, and a retaining washer 17. Except as described infra, these elements form no part of the present invention.

A quarterwave choke 30 is mounted on the right end of quartz tube 6 by being dimensioned to slip over the end of the tube 6. An identical quarterwave choke (not shown) is mounted on the other end (not shown) of quartz tube 6. Each quarterwave choke 30 comprises a conducting rivet 4 crimp-attached to the resistance heating element 5. The right end 33 of the rivet 4 is flared for rotatable mounting with pins 10 or 22. Mounted about rivet 4 is insulator 34. In the preferred embodiment, this is composed of a glass bonded mica such as Mycalex 410 from Spaulding Fiber Co., Buffalo, N.Y. Another useful insulator is porcelain enamel. Both are preferably bonded to rivet 4 prior to assembly. The rivet and insulator 34 combination are inserted into a plug combination comprising an inner cylinder 36 and a plug 2, each composed of a metal. They are preferably a unitary structure. Insulator block 3, which is preferably comprised of a glass bonded mica molded with insulator 34, retains rivet 4 from being drawn through inner cylinder 36. The last element of the assembly is outer cylinder 1 which is composed of a metal. Plug 2 mounts inside outer cylinder 1, closing off one end thereof. The other end 38 remains open.

The distance between the open end 38 of the outer cylinder 1 and the interior wall 40 of plug 2 is chosen to be $\frac{1}{4}$ of the effective wavelength of the microwave radiation present in the microwave oven cavity.

The gap between rivet 4 and inner cylinder 36 is critical. It can be no more than on the order of 0.015 to 0.020 inches when using glass bonded mica as an insulator 34.

The quartz lamp/quarterwave choke combination is removably mounted in the microwave oven cavity between the front socket assembly 20 and the rear socket assembly 26. A recess 32 is provided in metallic block 27 of the front socket assembly. The outer cylinder 1 inserts into this recess making metal-to-metal contact therewith choking off the exit of microwaves. Pin 22 mounts with the flared end of the rivet corresponding to 33 of the front choke. Spring 23 provides a "soft" contact for the quartz lamp 50. The pin 22/rivet (33) mounting provides for axial rotation of quartz lamp 50.

The rear socket assembly 26 has identical pin 10 and spring 12 combination for providing "soft" rotatable mounting of quartz lamp 50 via the flared end 33 of rivet 4. In addition, the mounting of choke 50 depresses cylindrical housing spring 30 a small distance to allow the outer cylinder 1 to sideably be received within the metallic socket housing 14. Metallic annular keeper 9 performs the function of grounding choke 50 to metallic socket housing 14, which in turn is grounded to cavity wall 18. Keeper 9 also limits the outward motion of cylindrical housing 11 within socket housing 14 via a raised lip 28 mounted on the housing 11.

Housing 11 is a metallic cylinder having closed end 29 which has an aperture to allow passage therethrough of ceramic cylindrical insulator 8 and insulated power lead 25. The diameter of the open end of housing 11 is chosen to be substantially the same as that of outer cylinder 1. When choke 50 is mounted in socket 26, outer cylinder 1 contacts housing 11 through its annulus, thereby grounding the exit of microwaves to power lead 25. Insulated power leads 19, 25, conduct electric power to quartz lamp 50.

The removable mounting means shown is not an essential feature of the present invention. Designers may prefer to fixedly mount the quartz heater in the oven. In that case, quarterwave chokes 30 may be directly mounted on a cavity wall.

The details of the preferred embodiment are not to be taken as a limitation on the scope of the appended claims, in which I claim:

1. A microwave oven comprising:

a microwave oven having a microwave oven cavity in which microwaves are present at cooking power, the cavity having at least one wall;

a quartz lamp mounted in said microwave oven cavity, the lamp including a quartz tube, a resistance element mounted in the quartz tube and two power leads connected to said resistance element, at least one of said power leads connected through said at least one cavity wall;

a quarterwave choke mounted about said at least one power lead and further mounted in the interior of said microwave oven cavity on said at least one cavity wall at the point the power lead exits from said microwave oven cavity; said quarterwave choke comprising:

a metallic outer cylinder;

a metallic plug having a central aperture mounted in one end of said outer cylinder leaving the other end open;

a hollow metallic inner cylinder mounted on said plug and extending through said outer cylinder to its open end about the central axis of said outer cylinder;

means for grounding said outer cylinder, said inner cylinder and said plug to said microwave oven cavity;

a conductor means mounted interior said inner cylinder and extending through the central aperture of said plug; said conductor means connected on one end to a power lead and on the other to said resistance heating element; the gap between the outside diameter of said conductor and the inside diameter of said metallic inner cylinder being less than or equal to 0.020 inches;

sheath means for electrically insulating said conductor means from said inner cylinder and said plug;

the distance between the open end of said outer cylinder and said metallic plug being substantially equal to a quarter of the wavelength of the microwave energy which may be present in said cavity.

2. The microwave oven of claim 1 wherein said insulating means is composed of a glass bonded mica.

3. The microwave oven of claim 1 wherein said insulating means is composed of a porcelain enamel.

4. The microwave oven of claim 1 wherein said insulating means further comprises an insulating plug means mounted in a recess mounted in the exterior of said metallic plug.

5. The microwave oven of claim 1 further including a socket mounted on said cavity wall into which said choke is removably mounted.

6. The microwave oven of claim 1 wherein said conductor means comprises a flared-end rivet extending through said choke and crimp-attached to said resistance heating element.

7. The microwave oven of claim 6 further including at least one metallic socket mounted on said cavity; said power lead extending therethrough and terminating in a flexible portion; a contact pin attached thereto and adapted for rotatable connection with the flared end of said rivet; a cylindrical insulator mounted about said contact pin and flexible portion; said cylindrical insulator having an open end and having a stop; a washer mounted on said contact pin for abutment against said stop to limit the motion of said contact pin; a cylindrical metallic housing slideably mounted in said socket and having a raised stop; said cylindrical insulator mounted in said housing; a metallic annular keeper mounted on the inside of said socket at an open end thereof; said annular keeper cooperating with said housing stop to limit the outward motion of said housing; and a biasing means mounted in said socket for urging said metallic housing outwards; the diameter of said metallic housing being the same diameter as said choke outer cylinder and adapted to contact same throughout its annulus when said choke is mounted in said socket to provide a microwave seal therebetween.

8. The microwave oven of claim 7 wherein the outside of said cylindrical metallic housing slideably contacts the inside of said keeper to provide a microwave seal therebetween.

9. The microwave oven of claim 6 further including at least one metallic socket mounted on said cavity interior through which one of said power leads extends and having an annular recess into which said outer cylinder removeably mounts in a contacting arrangement to thereby provide a microwave seal therebetween.

10. The microwave oven of claim 9 further including a contact pin mounted on said power lead and adapted for rotatable contact with the flared end of said rivet; a washer mounted on said contact pin, a cylindrical insulator mounted in said socket having a stop, said contact pin mounted in said insulator, biasing means mounted in said cylindrical insulator for urging said contact pin outwards, said stop and washer combination limiting the outward motion of the contact pin.

* * * * *

UNITED STATES PATENT AND TRADEMARK OFFICE

CERTIFICATE OF CORRECTION

PATENT NO. : 4,485,285

DATED : Nov. 27, 1984

INVENTOR(S) : Machesney

It is certified that error appears in the above—identified patent and that said Letters Patent is hereby corrected as shown below:

On the title page,
The name of assignee is changed from "Control Data Corporation" to "Micro-Quartz Technology Corporation"

Signed and Sealed this

*Twenty-third* Day of *April 1985*

[SEAL]

*Attest:*

DONALD J. QUIGG

*Attesting Officer* *Acting Commissioner of Patents and Trademarks*